US007720402B2

(12) United States Patent
Watanabe

(10) Patent No.: US 7,720,402 B2
(45) Date of Patent: May 18, 2010

(54) METHOD AND APPARATUS FOR IMAGE FORMING CAPABLE OF CONTROLLING TONER CONCENTRATION ACCURATELY

(75) Inventor: Naoto Watanabe, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 216 days.

(21) Appl. No.: 11/689,895

(22) Filed: Mar. 22, 2007

(65) Prior Publication Data

US 2007/0223946 A1 Sep. 27, 2007

(30) Foreign Application Priority Data

Mar. 22, 2006 (JP) ..... 2006-078867

(51) Int. Cl.
*G03G 15/08* (2006.01)
*G03G 15/00* (2006.01)

(52) U.S. Cl. ..... 399/74; 399/27; 399/30; 399/61; 399/62

(58) Field of Classification Search ..... 399/27–30, 399/61–63, 38
See application file for complete search history.

(56) References Cited

U.S. PATENT DOCUMENTS

| | | | | |
|---|---|---|---|---|
| 4,932,356 | A * | 6/1990 | Watanabe et al. | 118/689 |
| 5,107,301 | A * | 4/1992 | Yamauchi | 399/59 |
| 5,311,261 | A * | 5/1994 | Nakagama et al. | 399/63 |
| 6,665,503 | B2 * | 12/2003 | Sawayama | 399/63 |
| 2002/0154918 | A1 * | 10/2002 | Sawayama | 399/63 |
| 2005/0207766 | A1 | 9/2005 | Hasegawa et al. | |
| 2006/0002724 | A1 | 1/2006 | Fujimori et al. | |
| 2006/0024076 | A1 | 2/2006 | Kato et al. | |
| 2007/0036566 | A1 * | 2/2007 | Takeuchi et al. | 399/27 |
| 2007/0053703 | A1 * | 3/2007 | Hirayama | 399/27 |
| 2007/0086797 | A1 * | 4/2007 | Watanabe | 399/27 |

FOREIGN PATENT DOCUMENTS

| | | | |
|---|---|---|---|
| JP | 2002072660 A | * | 3/2002 |
| JP | 2002-207357 | | 7/2002 |
| JP | 2004163602 A | * | 6/2004 |

OTHER PUBLICATIONS

Machine translation of Japanese patent document JP-2002-072660.*
U.S. Appl. No. 11/932,198, filed Oct. 31, 2007, Takeuchi et al.

* cited by examiner

*Primary Examiner*—David M Gray
*Assistant Examiner*—G.M. Hyder
(74) *Attorney, Agent, or Firm*—Oblon, Spivak, McClelland, Maier & Neustadt, L.L.P.

(57) ABSTRACT

A toner-concentration controller includes a controller configured to control a toner supply amount in accordance with a detection result of a toner-concentration of two-component toner, and a sensor unit configured to detect the toner-concentration of two-component toner. The sensor unit includes a correction mechanism to correct an output signal of the sensor unit by changing an external-input voltage, based on relationship data between an output voltage change of the sensor unit and a toner-concentration of unused developer, to control the toner supply amount when the toner-concentration of the two-component toner deviates a predetermined amount from the toner-concentration of the unused developer. The sensor unit is configured to detect the toner-concentration of the unused developer from unused two-component toner based on a change in the external-input voltage.

15 Claims, 8 Drawing Sheets

METHOD AND APPARATUS FOR IMAGE FORMING CAPABLE OF CONTROLLING TONER CONCENTRATION ACCURATELY

This patent specification is based on Japanese patent application, No. 2006-078867 filed on Mar. 22, 2006 in the Japan Patent Office, the entire contents of which are incorporated by reference herein.

BACKGROUND OF THE INVENTION

1. Field of the Invention

The present invention relates to a method and apparatus for image forming, and more particularly to a method and apparatus for image forming capable of controlling toner-concentration accurately.

2. Discussion of the Background

An image forming apparatus that employs an electrophotographic method has been developed rapidly. Such an apparatus includes a printer, a copier, a facsimile machine, and a multi-function system, for example.

Recently, there is increasing demand that such an image forming apparatus have high stability and durability in addition to a high performance to obtain high quality images. Namely, it is requested that the image forming apparatus can maintain a constant quality of image forming that is less affected by environmental variation.

A background image forming apparatus commonly employs a two-component developer method using a two-component developer to visualize an image in an image forming operation because the two-component developer easily handles color images. The two-component developer (developer) includes non-magnetic toner and magnetic carrier.

In the two-component developer method, the background image forming apparatus holds the two-component developer on a developing sleeve which is a developer carrier. The background image forming apparatus forms a magnetic brush generated by magnetic poles provided in the developing sleeve. The two-component developer is conveyed to a developing region between the developing sleeve and a photoreceptor in accordance with a rotation of the developing sleeve. While the developer is conveyed to the developing region, a plurality of magnetic carriers in the developer are gathering together along a magnetic field generated by the magnetic poles to form the magnetic brush.

It is important to control a weight ratio of the toner and the carrier accurately to improve stability of the two-component developer. If toner-concentration is too high, scumming of the image may occur. As a result, resolution of a fine image may be decreased. Meanwhile, if toner-concentration is too low, another problems may occur. For example, low concentration may occur in a plain image area, or carrier adhesion may be generated.

To solve these problems, the toner-concentration of the developer needs to be adjusted to a necessary range by controlling the toner supply amount to the developer being used. Therefore, a sensor may be employed to detect the toner-concentration and to compare an output voltage of the sensor with a reference value of the toner-concentration. The toner supply amount is then determined based on the comparison result.

There are a variety of methods to detect toner-concentration. One method is to use a permeability sensor. A permeability of the developer changes when the toner-concentration of the developer is changed. The permeability sensor detects and compares a detected value with a reference value to determine if the toner supply amount needs to be adjusted.

Another method is to use a light sensor. In this method, a reference image pattern is formed on a photoreceptor, or an intermediate transfer belt initially. The light sensor detects light reflections from an image area having an actual image and a background area having no image. The toner-concentration of the developer is detected based on the detection result.

Further, the reference image pattern is transferred to paper from the photoreceptor or intermediate transfer belt during image forming process. The light sensor detects the light reflections from the image area and the background area on the paper. Then, a reference value Vref is controlled. However, in this method, toner is wasted because of the actual image forming on the photoreceptor, or the intermediate transfer belt, or during the transfer process to the paper.

In another background image forming apparatus, a controller detects toner-concentration of the developing unit and compares a detected value with a threshold value. The controller controls the toner-concentration of the developing unit by changing the threshold value by a predetermined value in accordance with a change of a linear velocity of a photoreceptor.

However, when the linear velocity of a photoreceptor is large, an output signal of the permeability sensor may be saturated. As a result, the toner-concentration can not be detected in the saturated region.

SUMMARY OF THE INVENTION

This patent specification describes a novel toner-concentration controller including a controller configured to control a toner supply amount in accordance with a detection result of a toner-concentration of two-component toner, and a sensor unit configured to detect the toner-concentration of two-component toner. The sensor unit includes a correction mechanism configured to correct an output signal of the sensor unit by changing an external-input voltage, based on relationship data between an output voltage change of the sensor unit of a toner-concentration of unused developer, to control the toner supply amount when the toner-concentration of the two-component toner deviates a predetermined amount from the toner-concentration of the unused developer. The sensor unit is configured to detect the toner-concentration of the unused developer from unused two-component toner based on a change in the external-input voltage.

Further, this patent specification describes a novel toner-concentration controller including a sensor unit which is a permeability sensor and including a resonant circuit and an oscillator. The resonant circuit includes a coil configured to change an inductance in accordance with a permeability of the two-component toner, and an adjusting mechanism configured to adjust an output of the resonant circuit by the external-input voltage when a change of the toner-concentration of the two-component toner is detected by an inductance change of the coil. The oscillator is configured to oscillate around a resonance frequency of the resonant circuit.

Further, this patent specification describes a novel method of controlling a toner-concentration, including the steps of detecting a toner-concentration of unused two-component toner with a sensor unit based on a change in an external-input voltage, detecting a toner-concentration of two-component toner during printing, supplying developer in accordance with an output signal of the sensor unit, and correcting an output signal of the sensor unit by changing the external-input voltage, based on relationship data between an output voltage change of the sensor unit and a the toner-concentration of unused developer, to control a toner supply amount when the toner-concentration of the two-component toner deviates a predetermined amount from the toner-concentration of the unused developer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
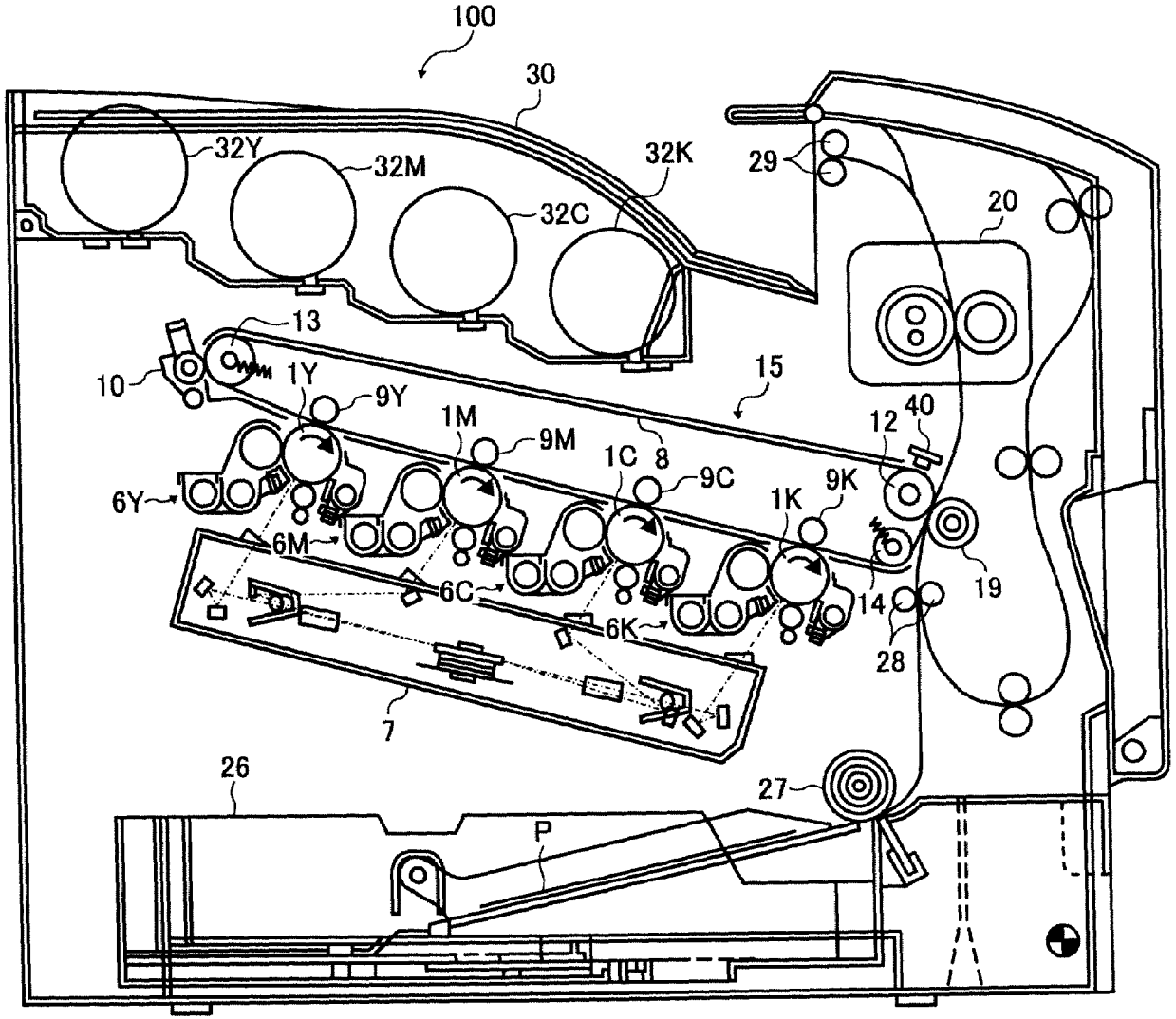
FIG. 1 is a printer as one exemplary embodiment of an image forming apparatus according to present disclosure.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 3, a toner-concentration controller according to an exemplary embodiment of the present invention is described.

FIG. 1 illustrates a first exemplary embodiment of a printer as one example of an image forming apparatus using electrophotography according to the present disclosure. A basic configuration of the printer will now be described.

Each image forming unit 6Y, 6M, 6C, and 6K forms a yellow (Y), magenta (M), cyan (C), and black (K) image respectively. Further, each toner image forming unit 6Y, 6M, 6C, and 6K is provided in a form of process cartridge which is detachably attached to the main body of the printer 100.

The four image forming units 6Y, 6M, 6C, and 6K (the process cartridges) have a same configuration, but handle different toner colors, yellow (Y), magenta (M), cyan (C), and black (K) as image forming materials. The process cartridges 6Y, 6M, 6C, and 6K may be exchanged before an end of their lifetime.

Figure 2:
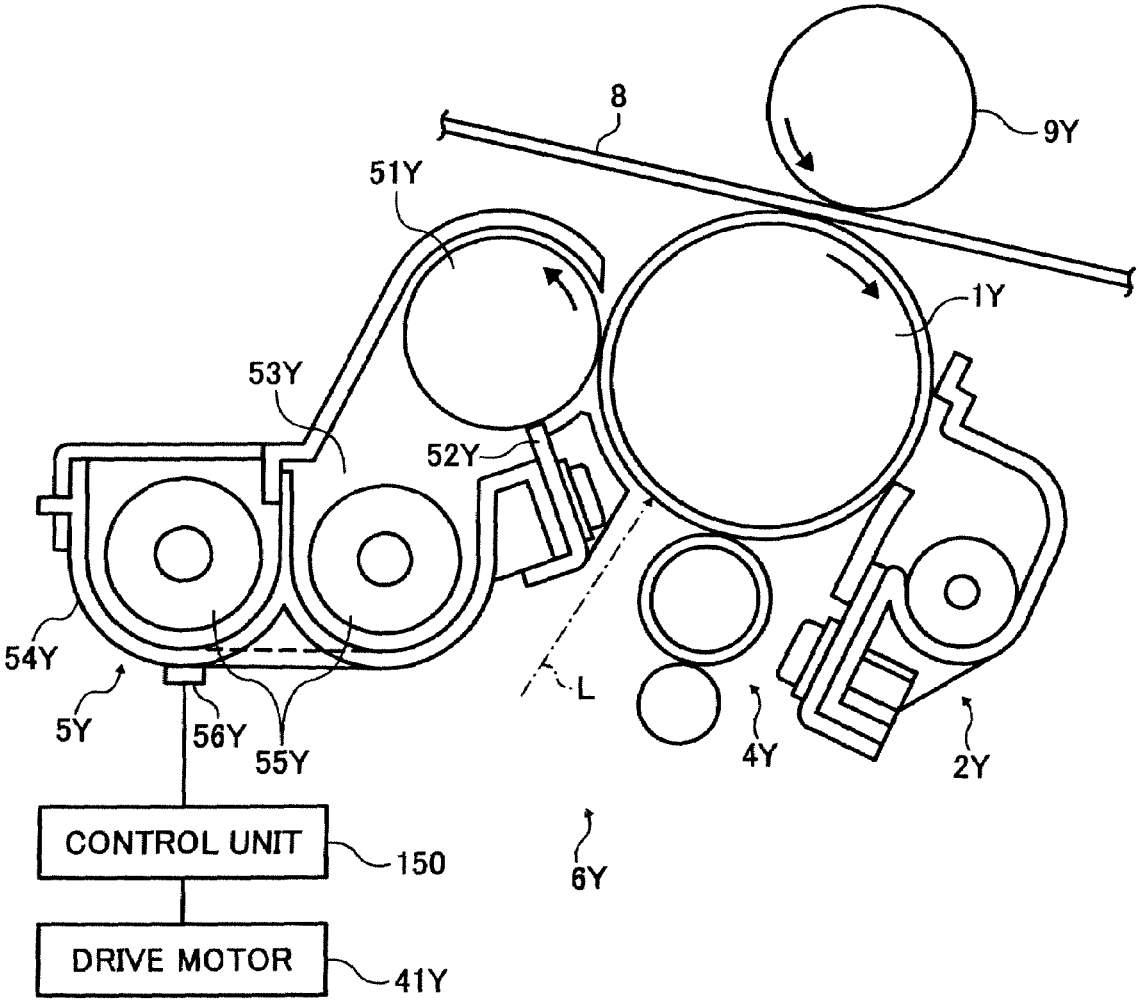
FIG. 2 is a relevant part of a toner image forming unit of the printer.

FIG. 2 illustrates the process cartridge 6Y for forming a yellow color toner image. As shown in FIG. 2, the process cartridge 6Y includes a photosensitive drum 1Y, a drum cleaning unit 2Y, a diselectrifier (not shown), a charging unit 4Y, and a developing unit 5Y. The above components are integrated in the process cartridge 6Y.

A permeability sensor 56Y (T-sensor) is provided underneath of the developing unit 5Y as a toner-concentration sensor which detects a toner-concentration in the developing unit 5Y. The process cartridge 6Y is detachably attached to the main body of the printer 100 and may be exchanged as a consumable part.

The charging unit 4Y charges uniformly a surface of the photosensitive drum 1Y which is rotated in a clockwise direction by a drive mechanism (not shown). A laser beam L emitted from a light-writing unit 7 (shown in FIG. 1), which is an exposure unit, is exposed and is scanned on the uniformly charged surface of the photosensitive drum 1Y in accordance with yellow image information. As a result, an electrostatic latent image of a yellow color is formed on the surface of the photosensitive drum 1Y. The electrostatic latent image of the yellow color is developed with a two-component developer which includes non-magnetic yellow toner and magnetic carrier.

A transfer bias potential is applied from a high voltage source (not shown) to a first transfer bias roller 9Y, which is a transfer mechanism, so as to form a transfer electric field. The toner image on the surface of the photosensitive drum 1Y is transferred onto an intermediate transfer belt 8 by the transfer electric field at a transfer position between the photosensitive drum 1Y and the intermediate transfer belt 8.

The drum cleaning unit 2Y removes residual toner on the surface of the photosensitive drum 1Y at a predetermined position after the surface of the photosensitive drum 1Y passes through the transfer position. The diselectrifier (not shown) diselectrifies the residual charge on the surface of the photosensitive drum 1Y after cleaning. By removing the electricity, the surface of the photosensitive drum 1Y is initialized to prepare for the next image forming process.

The developing unit 5Y forms a magnetic brush by magnetic poles provided in a developer sleeve 51Y by agitating and conveying the two-component developer 53Y stored in a developer storage 54Y by an agitating-conveyance member 55Y. The developer sleeve 51Y works as a developer carrier. The agitating-conveyance member 55Y and the developer sleeve 51Y are driven to be rotated by a rotation-drive mechanism (not shown).

When a process linear velocity is changed, linear velocities of the agitating-conveyance member 55Y and the developer sleeve 51Y are changed by the rotation-drive mechanism. The two-component developer 53Y on the developer sleeve 51Y is conveyed to a development region in accordance with the rotation of the developer sleeve 51Y.

A plurality of magnetic carriers in the two-component developer 53Y are gathering together along the magnetic field line formed by the magnetic poles provided in the developer sleeve 51Y. As a result, the magnetic carriers form the magnetic brush.

A thickness of the two-component developer 53Y on the developer sleeve 51Y is regulated by a regulatory member 52Y. A developing bias potential is applied from the high voltage source to the developer sleeve 51Y at a position where the developer sleeve 51Y faces the photosensitive drum 1Y.

The toner in the developer attaches on the electrostatic latent image. Thus, the electrostatic latent image is developed.

The toner is supplied into the developer storage 54Y of the developing unit 5Y from a toner supply unit 32Y. The toner supply unit 32Y (see FIG. 1) is driven by a drive motor 41Y so as to supply toner into the developer storage 54Y.

Referring again to FIG. 1, similarly to the developing unit 5Y of the process cartridges 6Y, each developing unit 5M, 5C, and 5K of the other process cartridges 6M, 6C, and 6K forms a magnetic brush by magnetic poles provided in the developer sleeves by agitating and conveying the two-component developer by agitating-conveyance members. The agitating-conveyance members and the developer sleeves are driven to be rotated by a rotation-drive mechanism (not shown).

When a process linear velocity is changed, linear velocities of the agitating-conveyance member and the developer sleeve are changed by the rotation-drive mechanism. The two-component developer on the developer sleeve is conveyed to a development region in accordance with the rotation of the developer sleeve. A plurality of magnetic carriers in the two-component developer are gathering together along the magnetic field line formed by the magnetic poles provided in the developer sleeve. As a result, the magnetic carrier forms the magnetic brush.

A thickness of the two-component developer on the developer sleeve is regulated by a regulatory member. A developing bias potential is applied from the high voltage source to the developer sleeve at a position where the developer sleeve faces the photosensitive drums 1M, 1C, and 1K. The toner in the developer attaches on the electrostatic latent image. Thus, the electrostatic latent image is developed.

Each color toner M, C, and K is supplied into the developer storage of developing units 5M, 5C, and 5K from toner supply units 32M, 32C, and 32K. The toner supply units 32M, 32C, and 32K are driven by drive motors 41M, 41C, and 41K to supply toner into the developer storage of the developing units 5M, 5C, and 5K.

As shown in FIG. 1, similar to the process cartridges 6Y, the process cartridges 6M, 6C, and 6K include photosensitive drums 1M, 1C, and 1K, drum cleaning units, diselectrifiers, charging units and developing units 5M, 5C, and 5K. Each toner image M, C, and K is formed on the photosensitive drums 1M, 1C, and 1K. Each color toner image is transferred onto the intermediate transfer belt 8 by being superimposed on the yellow toner image Y by the first transfer bias rollers 9M, 9C, and 9K which work as transfer mechanisms.

Underneath of the process cartridges 6Y, 6M, 6C, and 6K, the exposure unit 7 is provided as an electrostatic latent image forming unit. The exposure unit 7 emits each laser beam L from a plurality of light sources in accordance with each color image information. Each laser beam L is irradiated onto the photosensitive drums 1Y, 1M, 1C, and 1K, and exposes the surface of the photosensitive drums 1Y, 1M, 1C, and 1K.

The exposure unit 7 scans the laser beam L using a polygon mirror which is driven to be rotated by a motor and irradiates the laser beam L onto photosensitive drums 1Y, 1M, 1C, and 1K through a plurality of optical lenses and mirrors. Each electrostatic latent image is formed on the photosensitive drums 1Y, 1M, 1C, and 1K respectively.

Underneath of the exposure unit 7, a paper feed mechanism is provided. The paper feed mechanism includes a paper storage cassette 26 and a paper feed roller 27. The paper storage stores paper P by piling a plurality of the papers. The paper P is a recording medium to form the image thereon. The paper feed roller 27 contacts a top of the paper P. When the paper feed roller 27 is rotated in a counterclockwise direction by a drive mechanism (not shown), a paper P on top of the piled papers in the paper storage cassette 26 is fed by the paper feed roller 27 towards resist roller pair 28.

The resist roller pair 28 rotate to clip the paper P. Soon after clipping the paper P, the resist roller pair 28 stops to rotate temporarily. The resist roller pair 28 feeds the paper P towards a secondary transfer nip at a predetermined timing.

At an upper part of the process cartridges 6Y, 6M, 6C, and 6K, an intermediate transfer unit 15 is provided as an intermediate transfer mechanism which works as an image carrier. The intermediate transfer unit 15 includes an endless intermediate transfer belt 8 which is extended among a plurality of rollers and carries the image. The intermediate transfer unit 15 further includes four first transfer bias rollers 9Y, 9M, 9C, and 9K, a cleaning unit 10, a secondary transfer backup roller 12, a cleaning backup roller 13, and a tension roller 14 in addition to the intermediate transfer belt 8.

Further, the intermediate transfer belt 8 is extended among the secondary transfer backup roller 12, the cleaning backup roller 13, and the tension roller 14. The intermediate transfer belt 8 is moved by a rotation of at least one roller in a counterclockwise direction.

Each first transfer bias roller 9Y, 9M, 9C, and 9K forms a first transfer nip with the photosensitive drum 1Y, 1M, 1C, and 1K by clipping the intermediate transfer belt 8. A transfer bias potential which is opposite to the potential of the toner, for example, a plus voltage, is applied from the high voltage source to the inner surface of the intermediate transfer belt 8 through the first transfer bias rollers 9Y, 9M, 9C, and 9K. The secondary transfer backup roller 12, the cleaning backup roller 13, and the tension roller 14 are grounded.

While the intermediate transfer belt 8 is moving and is passing the first transfer nip for each color Y, M, C, and K serially, each toner image on the photosensitive drums 1Y, 1M, 1C, and 1K is transferred by superimposing one toner image after another. As a result, a superimposed four color toner image (full color image) is formed on the intermediate transfer belt 8.

The secondary transfer backup roller 12 forms a secondary transfer nip with the secondary transfer roller 19 by clipping the intermediate transfer belt 8. A transfer bias potential is applied from the high voltage source to the secondary transfer roller 19. The four color toner image formed on the intermediate transfer belt 8 is transferred onto the paper P fed from the resist roller pair 28 at the secondary transfer nip.

Residual toner, which is not transferred to the paper P, is adhered on a portion of the intermediate transfer belt 8 that has passed through the secondary transfer nip. The residual toner is removed by the cleaning unit 10.

At the secondary transfer nip, the paper P is clipped by the intermediate transfer belt 8 and the secondary transfer roller 19 and is conveyed to the opposite direction of the resist roller pair 28. The intermediate transfer belt 8 and the secondary transfer roller 19 move in the same direction at each surface contacting each other. The paper P fed from the secondary transfer nip passes through a fixing unit 20. While passing through the fixing unit 20, the four color toner image is fixed by heat and pressure.

The paper P is output to outside of the printer 100 through a paper-output roller pair 29. A stack unit 30 is provided at an upper part of the printer 100. The papers P are stacked one after another in the stack unit 30.

A reflective photo sensor 40 is provided at upper part of the secondary transfer backup roller 12 and works as an image-concentration-detecting mechanism. The reflective photo sensor 40 outputs a signal in accordance with a light reflection coefficient on the intermediate transfer belt 8.

As the reflective photo sensor 40, a diffusive light detection type sensor, or a specular-reflectance light detection type sensor, for example, may be selected depending on a condition to utilize a difference between a light reflective amount on the surface of the intermediate transfer belt 8 and a reference light reflective amount of a reference pattern. Operation of the reflective photo sensor 40 will be described later.

Figure 3:
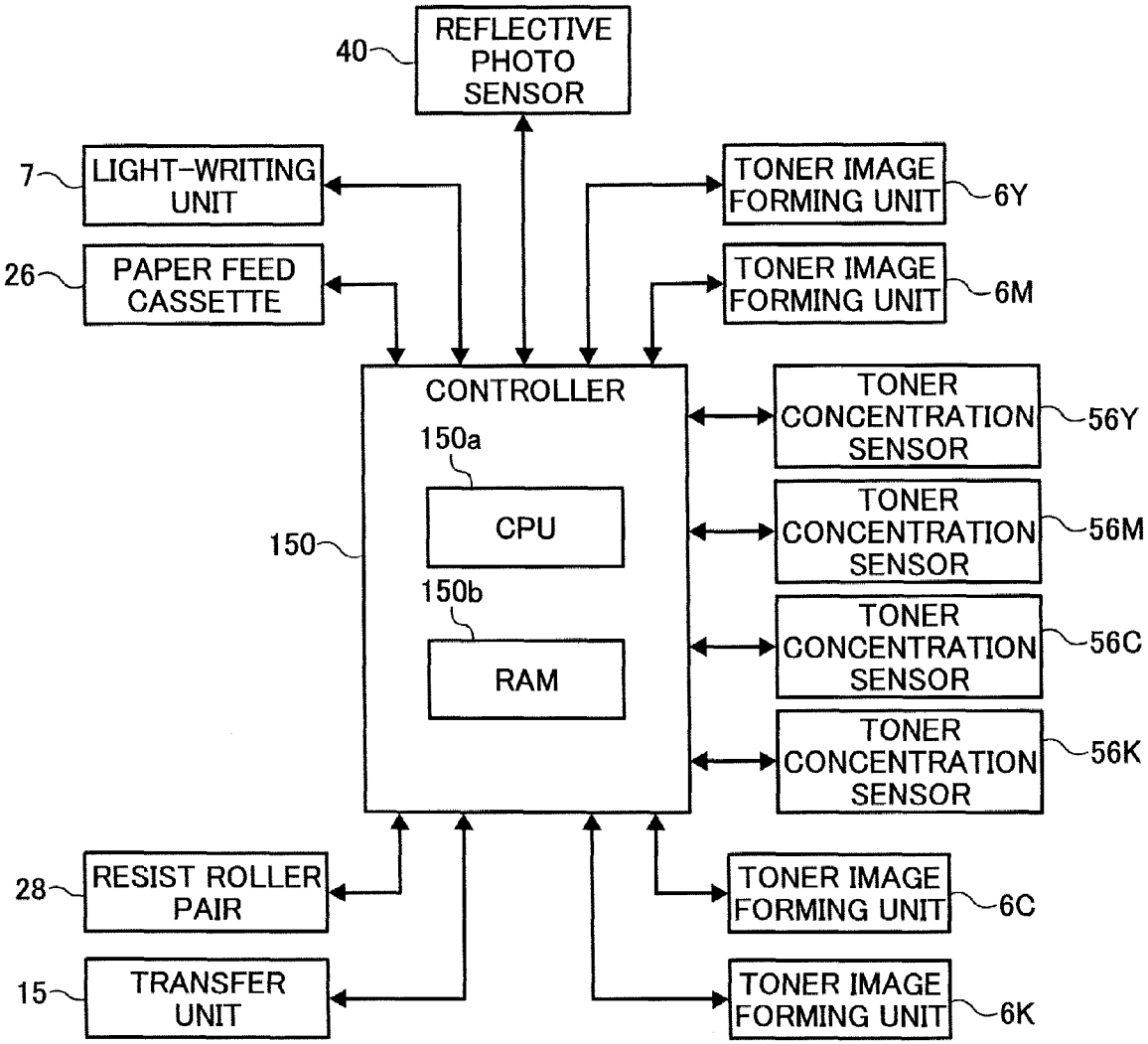
FIG. 3 is a block diagram showing a relevant part of an electric circuit of the printer.

FIG. 3 illustrates a block diagram showing a relevant part of an electric circuit of the printer 100. The printer 100 includes a controller 150 as shown in FIG. 3. The controller 150 controls toner image forming units 6Y, 6M, 6C, and 6K, a light-writing unit 7, the paper feed cassette 26, a rotation drive unit of the resist roller pair 28, the intermediate transfer unit 15, the reflective photo sensor 40, T-sensors 56 (56Y, 56M, 56C, and 56K) of the process cartridges 6Y, 6M, 6C, and 6K. Further, the controller 150 includes CPU (central processing unit) 150*a* and RAM (random access memory) 150*b*. The CPU 150*a* controls a computing unit (not shown) and the RAM 150*b* stores data.

The controller 150 examines image forming performances of the toner image forming units 6Y, 6M, 6C, and 6K at predetermined timings, for example, at an input of a main power (not shown), at a waiting time after a predetermined time from the main power input, and at a waiting time after a predetermined repetition of image forming operations. The controller 150 controls toner supply amounts, from each color toner supply unit 32Y, 32M, 32C, and 32K, to the developing unit 5Y, 5M, 5C, and 5K respectively.

More specifically, the controller 150 performs correction of the reflective photo sensor 40 at a predetermined time. At a correction process of the reflective photo sensor 40, the controller 150 searches an emitting light amount of the reflective photo sensor 40 to fit a detection voltage with a voltage 4.0v+−0.2v by changing the emitting light amount of the reflective photo sensor 40 sequentially. The emitting light amount obtained at the search process is used at a detection of a toner adhesive amount on the reference pattern.

Then, the controller 150 causes the charging units 4Y, 4M, 4C, and 4K to charge the photosensitive drums 1Y, 1M, 1C, and 1K uniformly by rotating the photosensitive drums 1Y, 1M, 1C, and 1K. The controller 150 causes the high voltage source to increase a charge-up voltage gradually applied to the photosensitive drums 1Y, 1M, 1C, and 1K. This procedure is different from a uniform charging process performed in a normal printing process. The charging voltage in the normal printing process may be, for example, −700v.

The controller 150 causes the light-writing unit 7 to form an electrostatic latent image of the reference image on the photosensitive drums 1Y, 1M, 1C, and 1K by scanning the laser beam. The electrostatic latent image is then developed on the toner image forming units 6Y, 6M, 6C, and 6K. Each color reference pattern image is formed on the photosensitive drums 1Y, 1M, 1C, and 1K respectively in this development process.

During the development process, the controller 150 causes the high voltage source to increase a developing bias voltage gradually applied to the toner image forming units 6Y, 6M, 6C, and 6K. As a result, a reference pattern image having a light concentration is formed on the photosensitive drums 1Y, 1M, 1C, and 1K at first. Then, reference pattern images having a darker concentration are being formed progressively. The pattern image forming process will be described in detail hereinafter.

On the contrary, if the charge-up and developing bias voltages for the photosensitive drums 1Y, 1M, 1C, and 1K are decreased gradually, a reference pattern image having a dark concentration is formed at first and reference pattern images having a lighter concentration are being formed progressively.

In general, it takes longer to decrease an output voltage of the high voltage source. Therefore, it may take longer to form the reference pattern if the output voltage of the high voltage source is decreased. Each color reference pattern image on the photosensitive drums 1Y, 1M, 1C, and 1K is formed on the intermediate transfer belt 8 to not overlap each other.

When each color reference pattern image passes through a point which faces the reflective photo sensor 40 in accordance with the movement of the intermediate transfer belt 8, each color reference pattern image is detected by the reflective photo sensor 40. The reflective photo sensor 40 generates a detection signal and sends the detection signal to the controller 150. The controller 150 calculates a light reflection coefficient of each reference image based on the detection signal sent from the reflective photo sensor 40.

The light reflection coefficient is stored in the RAM 150*b* as concentration pattern data. The reference pattern image formed on the intermediate transfer belt 8 is removed by the cleaning unit 10 after the reference pattern image passes through a point where the reflective photo sensor 40 faces the intermediate transfer belt 8.

Figure 4:
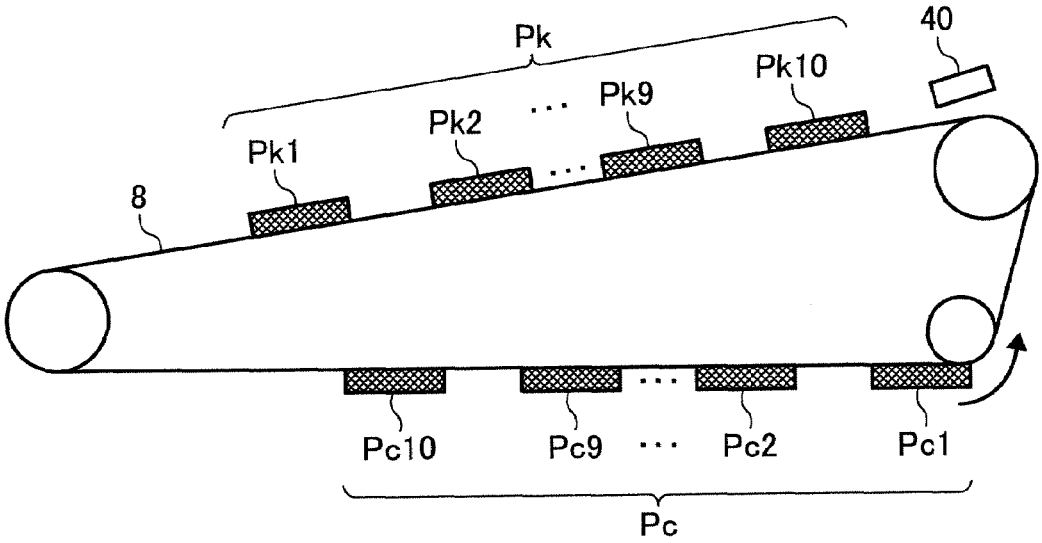
FIG. 4 is a schematic diagram of an intermediate transfer belt showing each color reference pattern.

FIG. 4 illustrates a schematic diagram of the intermediate transfer belt 8 showing a part of color reference patterns P (Py, Pm, Pc, and Pk). The reference pattern image Py is a yellow color pattern, the reference pattern image Pm is a magenta color pattern, the reference pattern image Pc is a cyan color pattern, and the reference pattern image Pk is a black color pattern. In FIG. 4, two reference pattern images Pk and Pc are shown. Each color pattern image includes ten reference image components (Pk1, Pk2, . . . , Pk9, Pk10, and Pc1, Pc2, . . . , Pc9, Pc10), which line up with a distance of 13 mm between each image component. The reference image components (Pm1 to Pm10, Py1 to Py10) will follow the reference image components (Pc1 to Pc10).

In the printer 100, each reference image component has a rectangular shape with a vertical size of 13 mm and a horizontal size of 5 mm. A length L2 of each reference pattern image Py, Pm, Pc, and Pk is 247 mm (L2=247 mm). The reference pattern images Py, Pm, Pc, and Pk are formed on the intermediate transfer belt 8 at different timings to not overlap each other. Thus, the image formation of the reference pattern image is different from the toner image formation at a normal printing process.

The reflective photo sensor 40 is provided above the intermediate transfer belt 8 at the upper right of FIG. 4. After the detection process of the reference pattern image, the reference pattern image is removed by the cleaning unit 10 of the intermediate transfer unit 15, referring to FIGS. 1 and 4.

The reflective photo sensor 40 detects the light reflections from each reference image component of the reference pattern image Py, Pm, Pc, and Pk in the following order.

The reflective photo sensor 40 detects the ten reference image components of the reference pattern image Pc after the detection of the ten reference image components of the reference pattern image Pk. Then, the reflective photo sensor 40 detects ten reference image components of the reference pattern image Pm and Py one after another. The reflective photo sensor 40 generates and outputs a voltage signal to the controller 150 in accordance with the light reflection of each reference pattern image. The controller 150 calculates image concentration of each reference image component based on the voltage signal sent from the reflective photo sensor 40. Calculated data is stored in the RAM 150*b* one after another.

Figure 5:
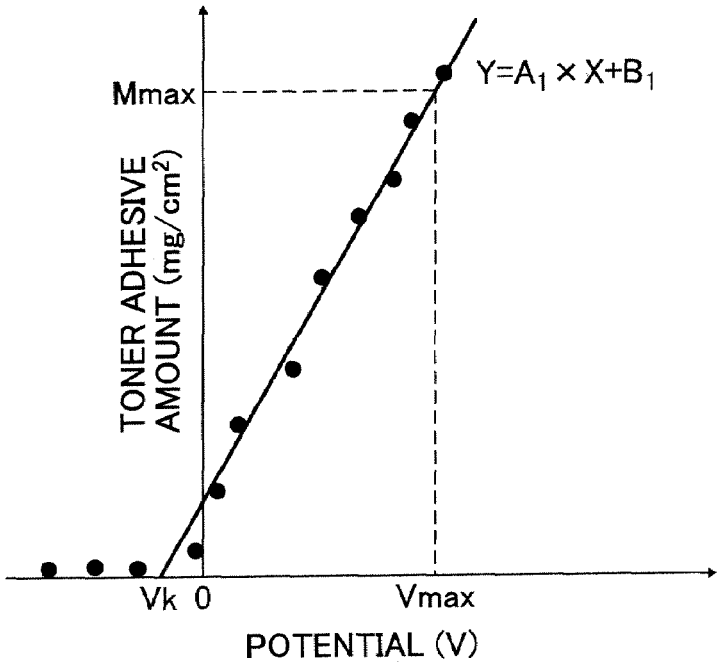
FIG. 5 is a plot of a relationship between a developing potential of each reference pattern image and a toner adhesive amount.

The controller 150 converts the image concentration of each reference image component to a toner adhesive amount in a following way. The controller 150 converts the output signal corresponding to each ten reference image components of the reference pattern image Py, Pm, Pc, and Pk to the toner adhesive amount based on the relationship between the toner adhesive amount and the detected voltage signal as shown in FIG. 5. Then, converted data is stored in the RAM 150*b*. While storing the converted data in the RAM 150*b*, the controller 150 estimates a developing potential from a condition of each reference pattern image. Information data of the reference pattern image is also stored in the RAM 150*b*. The process steps described above are performed on the reference pattern images Pk1, Pc1, Pm1, and Py1 one after another.

FIG. 5 is an X-Y plot of the relationship between a developing potential of each reference pattern image and a toner adhesive amount obtained by the process steps. In FIG. 5, potential (potential difference VB-VD between the developing potential VB and reference pattern image potential VD) (V) is shown on the X-axis and the toner adhesive amount M/A (mg/cm$^2$) is shown on the Y-axis.

The controller 150 selects a linear portion of the plotted data which represents the relationship between the developing potential of each reference pattern image and the toner adhesive amount. The controller 150 calculates a linear equation ($Y=A_1\times X+B_1$) for each color by applying the least-squares method to the plotted data in the linear portion. Further, the controller 150 calculates a developing potential to obtain a target toner adhesive amount by the linear equation. The calculated developing potential is fed back to image forming condition. Namely, the image forming condition is controlled by the developing potential. As a result, the image concentration can be kept to a predetermined level by the feed back process.

Figure 6:
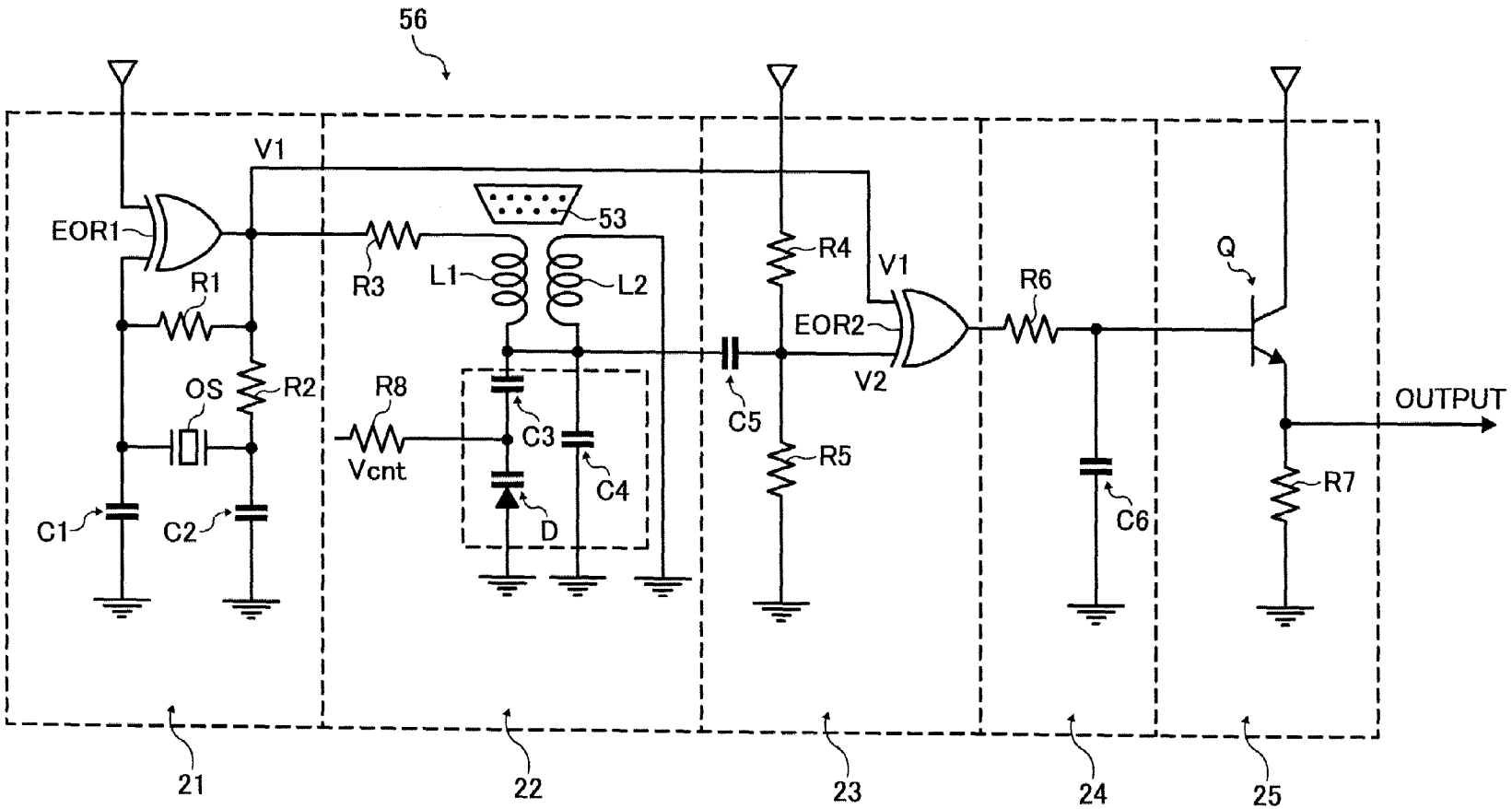
FIG. 6 is a circuit configuration of a toner concentration sensor (T-sensor)

FIG. 6 illustrates a circuit configuration of the T-sensor 56 (56Y, 56M, 56C, and 56K). The T-sensor 56 includes an oscillator 21, a resonance circuit 22, a phase comparator circuit 23, an integration circuit 24, and an impedance converting circuit 25. The oscillator 21 includes a resonator OS, capacitors C1 and C2, an exclusive OR-circuit EOR1, and resistors R1 and R2. The resonator OS includes solid resonator, for example, crystal resonator or ceramic resonator. The oscillator 21 oscillates with a natural frequency of the solid resonator.

The resonance circuit 22 includes first and second LC resonance circuits, and resistors R3 and R8. The first LC resonance circuit includes a coil L1, capacitor C3, and a variable capacitance diode D. The second LC resonance circuit includes a coil L2 and capacitor C4. The coils L1 and L2 are coupled with a magnetic-coupling-coefficient constant k.

The oscillation frequency of the oscillator 21 is close to the resonance frequency of the first and second LC resonance circuits. Inductances of the coils L1 and L2 change in accordance with permeability (toner-concentration) of developer 53 (53Y, 53M, 53C, and 53K) in developing unit 5. A control voltage is applied as an external voltage Vcnt to both ends of the variable capacitance diode D from the controller 150 through resistor R8.

The resonance circuit 22 receives an output signal of the oscillator 21 and changes an output of the resonance circuit 22 in accordance with a difference between the oscillation frequency of the oscillator 21 and the resonance frequency of the resonance circuit 22. The permeability (toner-concentration) of developer 53 (53Y, 53M, 53C, and 53K) is detected by the output change of the resonance circuit 22 because the permeability (toner-concentration) of developer 53 (53Y, 53M, 53C, and 53K) in developing unit 5 affects the resonance frequency of the resonance circuit 22.

The phase comparator circuit 23 includes an exclusive OR-circuit EOR2, capacitor C5, and resistors R4 and R5. The exclusive OR-circuit EOR2 has a first voltage V1, from the oscillator 21, and a second voltage V2, from the resonance circuit 22, as inputs. The phase comparator circuit 23 compares a phase of the oscillator 21 with a phase of the resonance circuit 22 and detects a phase difference between them. The integration circuit 24 includes a resistor R6 and a capacitor C6 to integrate an output of the phase comparator circuit 23.

The impedance converting circuit 25 includes a transistor Q and a resistor R7 to perform impedance conversion. The output signal of the integration circuit 24 is output to the controller 150 as a toner-concentration detection signal through the impedance converting circuit 25. The toner-concentration detection signal is a corresponding signal to the change of the permeability (toner-concentration) of developer 53 (53Y, 53M, 53C, and 53K) in developing unit 5.

In the printer 100, when brand new process cartridges 6Y, 6M, 6C and 6K are installed, the controller 150 performs correction of the T-sensors 56Y, 56M, 56C and 56K of the process cartridges 6Y, 6M, 6C and 6K under a constant toner-concentration using unused two-component developer. The developing unit 5Y, 5M, 5C and 5K of the brand new process cartridge 6Y, 6M, 6C and 6K includes unused developer having a toner-concentration of 8 wt %.

The controller 150 changes the external-input voltage Vcnt of the T-sensors 56Y, 56M, 56C, and 56K so that each output voltage Vt of the T-sensors 56Y, 56M, 56C, and 56K becomes 2.5v with respect to the developer having the toner-concentration of 8 wt % for each color. The controller 150 stores the external-input voltage Vcnt during the correction process of the T-sensors 56Y, 56M, 56C, and 56K. When T-sensors 56Y, 56M, 56C, and 56K perform detection, the controller 150 sets the external-input voltage Vcnt of the T-sensors 56Y, 56M, 56C, and 56K with the stored Vcnt values.

During a normal printing operation, the toner-concentration of the developer 53 in the developing unit 5 is detected by the T-sensors 56Y, 56M, 56C, and 56K. The controller 150 controls toner supply units 32Y, 32M, 32C, and 32K to supply toner to the developing units 5Y, 5M, 5C, and 5K by controlling the drive motors 41Y, 41M, 41C, and 41K of the toner supply units 32Y, 32M, 32C, and 32K respectively in accordance with differences between each output voltage Vt and target value Vtref of the T-sensors 56Y, 56M, 56C, and 56K.

More specifically, the controller 150 determines a toner supply amount based on following formulas (1) and (2). The controller 150 controls the toner supply units 32Y, 32M, 32C, and 32K to supply toner to the developing units 5Y, 5M, 5C, and 5K by driving toner drive motors (not shown) of the toner supply units 32Y, 32M, 32C, and 32K respectively based on the toner supply amount determined by the formulas (1) and (2).

When Vt>Vtref, $$\text{Toner supply amount}=\alpha\times(Vt-Vtref)/(\text{sensitivity of } T\text{-sensor}) \quad (1)$$

When Vt<Vtref, $$\text{Toner supply amount}=0 \quad (2)$$

where $\alpha$ is a proportional constant which defines a response of the toner supply amount to the toner-concentration detection of the T-sensors 56Y, 56M, 56C, and 56K. In the first exemplary embodiment of the disclosure, $\alpha$ is 0.3.

Figure 7:
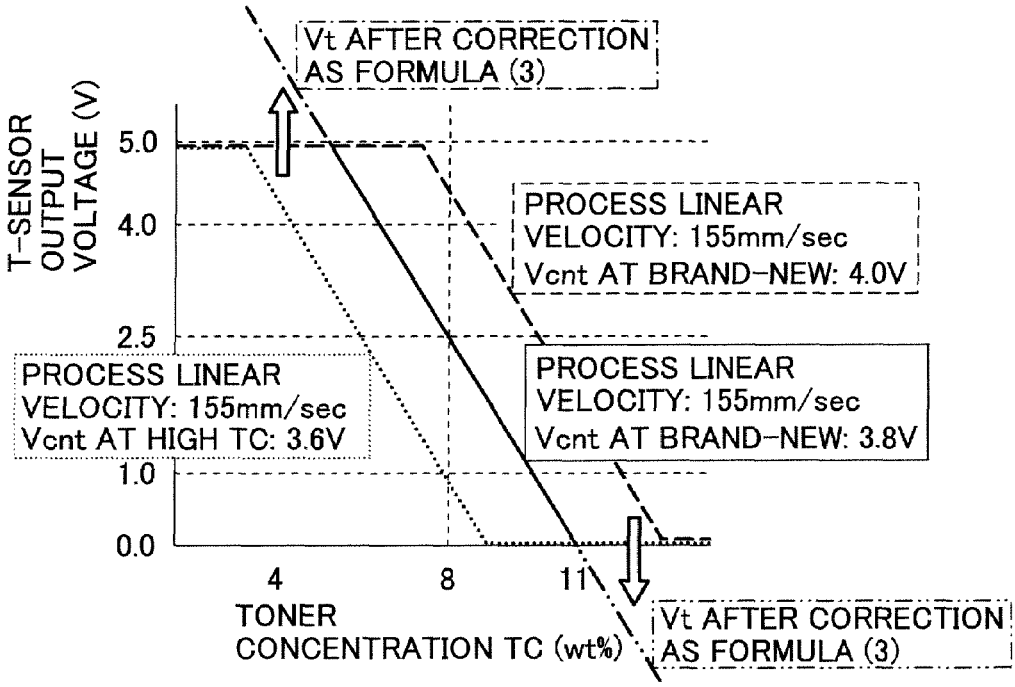
FIG. 7 is a graph representing a relationship between a toner-concentration and an output voltage of the T-sensor at a large change of the toner-concentration.

FIG. 7 is a graph representing a relationship between the toner-concentration TC and the output voltage Vt of the T-sensors 56Y, 56M, 56C, and 56K. When the toner-concentration is in a low region, Vt is saturated at 5v as shown in FIG. 7. Therefore, it is not possible to detect the toner-concentration accurately. Meanwhile, when the toner-concentration is in a high region, Vt is saturated at 0v as shown in FIG. 7. Therefore, it is also not possible to detect the toner-concentration accurately.

When the toner-concentration is in the low region, i.e. Vt is at a predetermined Vt or more, but is saturated, the controller 150 uses a different Vcnt value by replacing the Vcnt value obtained with the brand-new developer.

In the first exemplary embodiment of the disclosure, when the toner-concentration of the two-component toner is changed significantly from the toner-concentration of the unused developer to a Vt value, for example, Vt>4.0v, the controller 150 uses a lower Vcnt value by 0.2v different from the Vcnt value obtained with the brand-new developer. Namely, the controller 150 takes 3.6v as the Vcnt value. With this change, it becomes possible to detect the toner-concentration at the lower region of the toner-concentration.

Meanwhile, when the toner-concentration is in the high region, i.e. Vt is at a predetermined Vt or less but is saturated, the controller 150 uses a different Vcnt value by replacing the Vcnt value from the Vcnt value obtained when the cartridges 6Y, 6M, 6C, and 6K are exchanged with the brand-new cartridges. In this case, the controller 150 uses a higher value by 0.2v than the initial setting value oppositely to the case in which the toner-concentration is in the low region. Namely, the controller 150 takes 4.0v as the Vcnt value to detect Vt. With this change, it becomes possible to detect the toner-concentration at the high region of the toner-concentration in which Vt was not detected due to a saturation of the Vt value.

When the Vcnt value changes, the Vt value also changes as shown in FIG. 7. Therefore, correction of the Vt value is necessary to match a shifted Vcnt value. There may still be some variation among the permeability sensors. However, a relationship between the Vcnt and Vt values is approximately constant as shown in FIG. 8.

Figure 8:
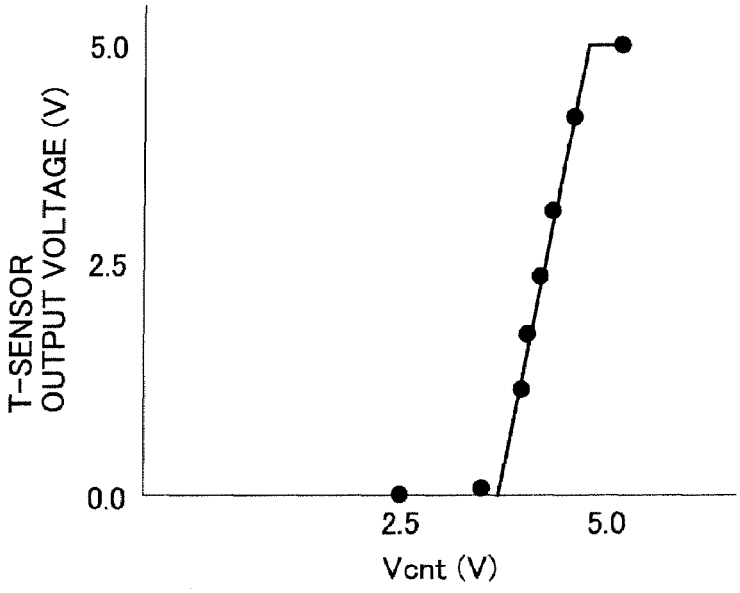
FIG. 8 is a plot of a relationship between an external-input voltage and an output voltage of the T-sensor.

The controller 150 performs correction of the Vt value based on a formula (3), $$(Vt \text{ after correction}) = (\text{detected value of } Vt) - \Delta Vcnt \times S \quad (3)$$

where ΔVcnt is a variation of the Vcnt value when the toner-concentration changes, and S is a slope of a data line (Vt vs Vcnt) of FIG. 8. In this exemplary embodiment, S is 4.0.

Thus, the controller 150 performs correction of the Vt value so that the relationship between the toner-concentration and the Vt value has a linear relationship in a wide range from a low toner-concentration to a high toner-concentration shown as a line expressed by "Vt value after correction as formula (3)" in FIG. 7. As a result, the toner-concentration can be determined with one relationship regarding the Vt value.

According to the first exemplary embodiment, the printer has an adjusting mode which can cancel the output variation by adjusting the external-input voltage Vcnt. The T-sensors 56Y, 56M, 56C, and 56K are toner-concentration sensors. Initially, the T-sensors 56Y, 56M, 56C, and 56K detect the toner-concentration by changing the external-input voltage of the T-sensors 56Y, 56M, 56C, and 56K under a constant toner-concentration using unused two-component developer.

The output signal of the toner-concentration sensor is corrected by changing the external-input voltage based on the relationship between T-sensors 56Y, 56M, 56C, and 56K versus the external-input voltage when the toner-concentration of the two-component toner deviates from the toner-concentration of the unused developer.

Thus, the T-sensors 56Y, 56M, 56C, and 56K are corrected by the external-input voltage so that the T-sensors 56Y, 56M, 56C, and 56K output an appropriate toner-concentration detection signal. The output of the T-sensors 56Y, 56M, 56C, and 56K does not saturate even when the deviation of the toner-concentration of the two-component toner is large. As a result, it is possible to detect the toner-concentration accurately.

As another image forming apparatus using the electrophotographic method, a printer according to a second exemplary embodiment will be described. The controller 150 obtains a slope S of the linearity between Vcnt and Vt values shown in FIG. 8 during a correction process of the T-sensors 56Y, 56M, 56C, and 56K by changing the external-input voltage Vcnt to the T-sensors 56Y, 56M, 56C, and 56K so that each output voltage Vt of the T-sensors 56Y, 56M, 56C, and 56K becomes 2.5v with respect to the developer having 8 wt %.

While obtaining Vt values, as shown by the plot in FIG. 8, in the correction process, the controller 150 performs approximation for the plot in a linear region of Vcnt and Vt using the least-square method. The calculated slope is defined as S. Thus, the slope S is obtained directly. As a result, the Vt variation of the T-sensors 56Y, 56M, 56C, and 56K can be reduced and the detection accuracy is improved.

According to the second exemplary embodiment, the T-sensors 56Y, 56M, 56C, and 56K detect the toner-concentration by changing the external-input voltage under a constant toner-concentration. The output voltage of the toner-concentration sensor of T-sensors 56Y, 56M, 56C, and 56K to the external-input voltage Vcnt are stored. (correction mode of the T-sensors 56Y, 56M, 56C, and 56K)

The controller 150 is a toner-concentration-sensor-output-correction mechanism and controls the change to the external-input voltage based on the relationship between the output voltage of T-sensors 56Y, 56M, 56C, and 56K to the external-input voltage Vcnt stored in RAM 150*b*, when the toner-concentration of the two-component toner deviates from the toner-concentration of the unused developer. The controller 150 performs the correction of the output voltage of the T-sensors 56Y, 56M, 56C, and 56K. As a result, it is possible to detect the toner-concentration more accurately by detecting the Vt variation at the change of Vcnt value.

Further, according to the first and second exemplary embodiments, the controller 150 performs output voltage correction of the T-sensors 56Y, 56M, 56C, and 56K by changing the external-input voltage when the permeability of the two-component developer deviates from the permeability of the unused developer. Even if the permeability change of the two-component toner is large, the output voltage of the T-sensors does not saturate. As a result, it is possible to detect the toner-concentration accurately.

Figure 9:
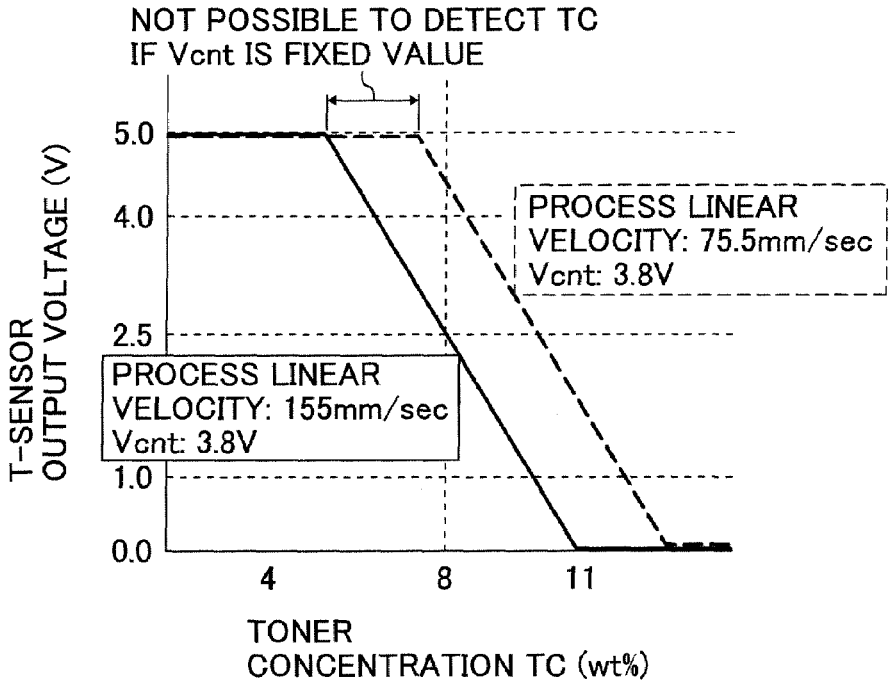
FIG. 9 is a graph representing a relationship between a toner-concentration and an output voltage of the T-sensor when a process linear velocity is changed.

As another image forming apparatus using the electrophotographic method, a printer according to a third exemplary embodiment will be described. The printer according to the third exemplary embodiment changes the Vcnt value when the printer changes a linear velocity. If the printer changes the linear velocity from a normal velocity down to a half velocity keeping the Vcnt value, the apparent permeability of the two-component toner increases. As a result, Vt is saturated in the low toner-concentration, as shown in FIG. 9, and the actual toner-concentration cannot be detected.

When the process linear velocity is changed from the normal linear velocity of 155 mm/sec down to the half linear velocity of 75.5 mm/sec, the controller 150 sets the Vcnt value with a lower value than a predetermined Vcnt value at the normal linear velocity, in accordance with a linear-velocity-exchange signal sent from a linear-velocity-exchange unit, to match a relationship between the toner-concentration and the Vt value at the normal linear velocity.

In this case, changing the amount of Vcnt may not be applied to Δvcnt of formula (3). Then, a similar toner-concentration detection range can be obtained independently of the process linear velocity.

According to the third exemplary embodiment, the controller 150 performs a correction of the output voltage of the T-sensors 56Y, 56M, 56C, and 56K by changing the external-input voltage when the process linear velocity changes. As a result, it is possible to detect the toner-concentration accurately at the change of linear velocity without saturation of the output voltage of the T-sensors 56Y, 56M, 56C, and 56K.

As another image forming apparatus using the electrophotographic method, a printer according to a fourth exemplary embodiment will be described. The printer according to the fourth exemplary embodiment changes the Vcnt value when an environment sensor (not shown) detects a change of temperature and humidity.

Figure 10:
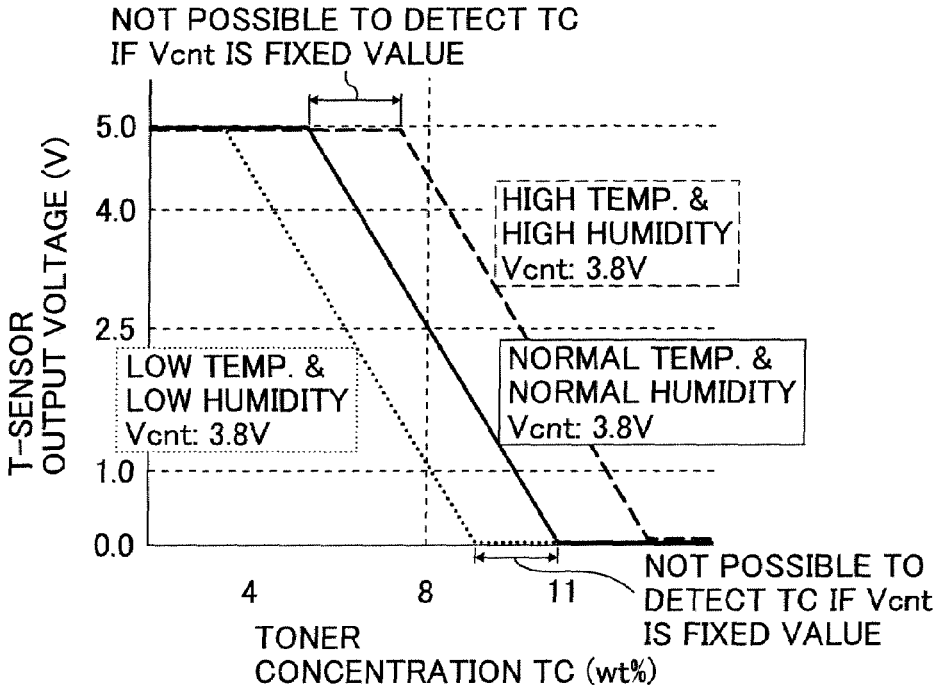
FIG. 10 is a graph representing a relationship between a toner-concentration and an output voltage of the T-sensor at each condition of temperature and humidity.

If the environment in which the image forming apparatus operates becomes a high temperature and a high humidity environment, the apparent permeability of the two-component toner increases. Meanwhile, if it becomes a low temperature and a low humidity environment, an apparent permeability of the two-component toner decreases. As a result, the toner-concentration cannot be detected in the high toner-concentration at the high temperature and high humidity environment and cannot be detected in the low toner-concentration at the low temperature and low humidity environment as shown in FIG. 10.

The controller 150 sets the Vcnt value to a lower value at the high temperature and high humidity environment and sets the Vcnt value to a predetermined higher value at the low temperature and low humidity environment in accordance with a detection signal from the environment sensor. With this setting, a relationship between the toner-concentration and the Vt value at the high and temperature and high humidity environment becomes a similar relationship to the normal temperature and normal humidity environment. Similarly, a relationship between the toner-concentration and the Vt value at the low temperature and low humidity environment becomes similar to the relationship at the normal temperature and normal humidity environment.

In these cases, changing the amount of Vcnt may not be applied to ΔVcnt of formula (3). Then, a similar toner-concentration detection range can be obtained independently of the temperature and humidity.

According to the fourth exemplary embodiment, the controller 150 performs a correction of the output voltage of the T-sensors 56Y, 56M, 56C, and 56K by changing the external-input voltage when the temperature and humidity changes. As a result, it is possible to detect the toner-concentration accurately when the temperature and humidity change without saturation of the output voltage of the T-sensors 56Y, 56M, 56C, and 56K.

As another image forming apparatus using the electrophotographic method, a printer according to a fifth exemplary embodiment will be described. The printer according to the fifth exemplary embodiment changes the Vcnt value in accordance with an image area ratio. The image area ratio is a ratio of the image to be transferred onto paper, or the electrostatic latent image to be developed, or the image input to the developing unit with respect to an area of a paper.

Figure 11:
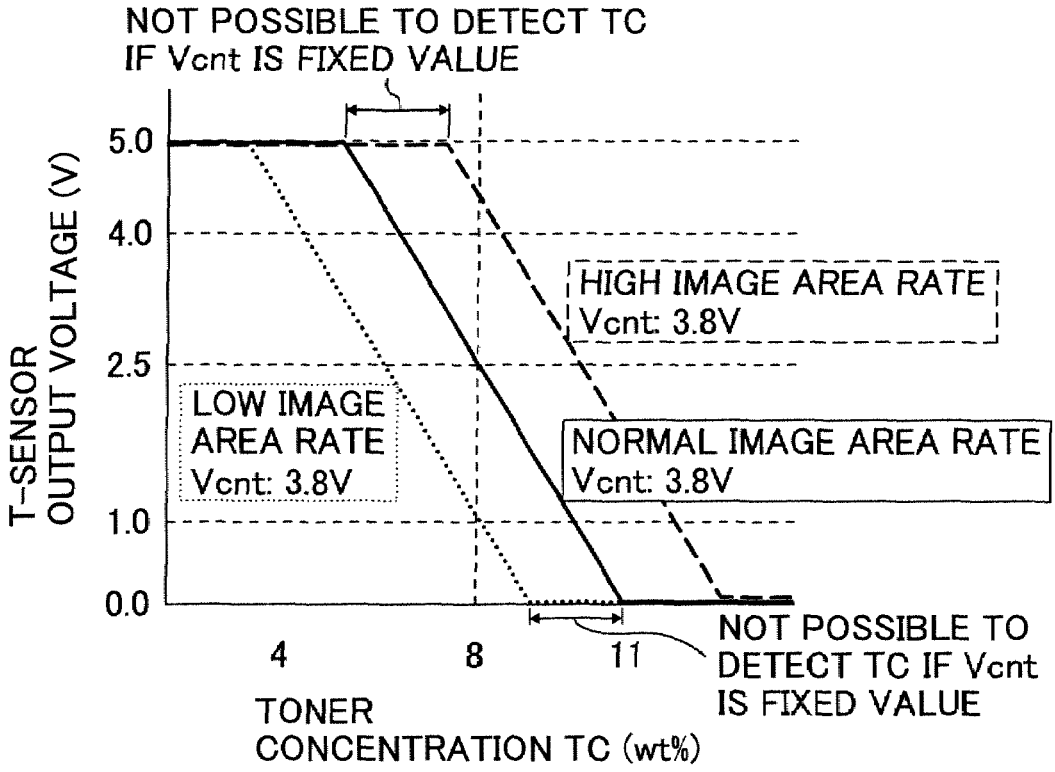
FIG. 11 is a graph representing a relationship between a toner-concentration and an output voltage of the T-sensor at each image area ratio.

If the image area ratio is high, the apparent permeability of the two-component toner increases. Meanwhile, if the image area ratio is low, the apparent permeability of the two-component toner decreases. As a result, the toner-concentration cannot be detected in the high toner-concentration at the high image area ratio and cannot be detected in the low toner-concentration at the low image area ratio, as shown in FIG. 11.

The controller 150 calculates the image area ratio from the image data input or transmitted to the developing unit 7. The controller 150 defines a calculated image area ratio as the image area ratio on the paper.

The controller 150 performs a correction of the Vcnt value with a predetermined lower value when the image area ratio is higher than a first predetermined value, and performs a correction of the Vcnt value with a predetermined higher value when the image area ratio is lower than a second predetermined value. With this setting, the relationship between the toner-concentration and the Vt value at deviated image area ratios becomes the relationship at the normal image area ratio.

In these cases, changing the amount of Vcnt may not be applied to ΔVcnt of formula (3). Then, a similar toner-concentration detection range can be obtained independently on the image area ratio.

According to the fifth exemplary embodiment, the controller 150 performs a correction of the output voltage of the T-sensors 56Y, 56M, 56C, and 56K by changing the external-input voltage in accordance with the image area ratio. As a result, it is possible to detect the toner-concentration accurately even at a large change of the toner-concentration due to a change of the image area ratio without saturation of the output voltage of the T-sensors 56Y, 56M, 56C, and 56K.

Numerous additional modifications and variations are possible in light of the above teachings. It is therefore to be understood that within the scope of the appended claims, the disclosure of this patent specification may be practiced otherwise than as specifically described herein.

What is claimed is:

1. A toner-concentration controller, comprising:

a controller configured to control a toner supply amount in accordance with a detection result of a toner-concentration of two-component toner; and a sensor unit configured to detect the toner-concentration of the two-component toner, the sensor unit including, a correction mechanism configured to correct an output signal of the sensor unit by changing an external-input voltage input to the sensor unit when a process linear velocity changes, and the external-input voltage is changed to match a relationship between the toner-concentration and an output voltage at a normal linear velocity, based on relationship data between an output voltage change of the sensor unit and a toner-concentration of unused developer, to control the toner supply amount when the toner-concentration of the two-component toner deviates a predetermined amount from the toner-concentration of the unused developer, wherein the sensor unit is configured to detect the toner-concentration of the unused developer from unused two-component toner based on a change in the external-input voltage.

2. The toner-concentration controller of claim 1, wherein the sensor unit is a permeability sensor and includes a resonant circuit and an oscillator, the resonant circuit including a coil configured to change an inductance in accordance with a permeability of the two-component toner, and an adjusting mechanism configured to adjust an output voltage of the resonant circuit by the external-input voltage when a change of the toner-concentration of the two-component toner is detected by an inductance change of the coil, and the oscillator is configured to oscillate around a resonance frequency of the resonant circuit.

3. The toner-concentration controller of claim 1, wherein the correction mechanism is configured to store correlation data between the output voltage of the sensor unit and the external-input voltage obtained by changing the external-input voltage under a constant condition of the toner-concentration, and the correction mechanism is configured to correct the output voltage of the sensor unit using the correlation data by changing the external-input voltage when the toner-concentration of the two-component toner deviates a predetermined amount from the toner-concentration of the unused developer.

4. The toner-concentration controller of claim 1, wherein the correction mechanism is configured to correct the output signal of the sensor unit by changing the external-input voltage when a permeability of the two-component toner deviates a predetermined amount from a permeability of the unused developer.

5. The toner-concentration controller of claim 1, wherein, after the external-input voltage is changed to match the relationship between the toner-concentration and the output voltage at the normal linear velocity, the control of the toner supply amount can be performed independently of the process linear velocity.

6. The toner-concentration controller of claim 1, wherein the normal linear velocity is 155 mm/sec.

7. The toner-concentration controller of claim 1, wherein, when the process linear velocity is lower than the normal linear velocity, the external-input voltage is set to a lower value than a predetermined external-input voltage at the normal linear velocity.

8. An image forming apparatus, comprising:

a controller configured to control a toner supply amount in accordance with a detection result of a toner-concentration of two-component toner; and a sensor unit configured to detect the toner-concentration of the two-component toner, the sensor unit including, a correction mechanism configured to correct an output signal of the sensor unit by changing an external-input voltage input to the sensor unit when a process linear velocity changes, and the external-input voltage is changed to match a relationship between the toner-concentration and an output voltage at a normal linear velocity, based on relationship data between an output voltage change of the sensor unit and a toner-concentration of unused developer, to control the toner supply amount when the toner-concentration of the two-component toner deviates a predetermined amount from the toner-concentration of the unused developer, wherein the sensor unit is configured to detect the toner-concentration of the unused developer from unused two-component toner based on a change in the external-input voltage.

9. The image forming apparatus of claim 8, wherein, after the external-input voltage is changed to match the relationship between the toner-concentration and the output voltage at the normal linear velocity, the control of the toner supply amount can be performed independently of the process linear velocity.

10. The image forming apparatus of claim 8, wherein the normal linear velocity is 155 mm/sec.

11. The image forming apparatus of claim 8, wherein, when the process linear velocity is lower than the normal linear velocity, the external-input voltage is set to a lower value than a predetermined external-input voltage at the normal linear velocity.

12. A method of controlling a toner-concentration, comprising:

detecting a toner-concentration of unused two-component toner with a sensor unit based on a change in an external-input voltage;

detecting a toner-concentration of two-component toner during printing;

supplying developer in accordance with an output signal of the sensor unit; and correcting the output signal of the sensor unit by changing the external-input voltage input to the sensor unit when a process linear velocity changes, and the external-input voltage is changed to match a relationship between the toner-concentration of the two-component toner and an output voltage at a normal linear velocity, based on relationship data between an output voltage change of the sensor unit and a toner-concentration of unused developer, to control a toner supply amount when the toner-concentration of the two-component toner deviates a predetermined amount from the toner-concentration of the unused developer.

13. The method of claim 12, wherein, after the external-input voltage is changed to match the relationship between the toner-concentration of the two-component toner and the output voltage at the normal linear velocity, the control of the toner supply amount can be performed independently of the process linear velocity.

14. The method of claim 12, wherein the normal linear velocity is 155 mm/sec.

15. The method of claim 12, wherein, when the process linear velocity is lower than the normal linear velocity, the external-input voltage is set to a lower value than a predetermined external-input voltage at the normal linear velocity.

* * * * *